US010683474B2

(12) United States Patent
Brooker et al.

(10) Patent No.: US 10,683,474 B2
(45) Date of Patent: Jun. 16, 2020

(54) COMPACTED LIQUID LAUNDRY DETERGENT COMPOSITION

(71) Applicant: The Procter & Gamble Company, Cincinnati, OH (US)

(72) Inventors: Alan Thomas Brooker, Newcastle upon Tyne (GB); Philip Frank Souter, Northumberland (GB); Nigel Patrick Somerville-Roberts, Newcastle upon Tyne (GB); Dan Xu, Newcastle upon Tyne (GB); Jeremie Robert Marcel Gummel, Newcastle upon Tyne (GB); Jean-Pol Boutique, Gembloux (GB); Hugo Robert Germain Denutte, Hofstade (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/170,961

(22) Filed: Jun. 2, 2016

(65) Prior Publication Data

US 2016/0355762 A1 Dec. 8, 2016

(30) Foreign Application Priority Data

Jun. 5, 2015 (EP) ..... 15170775

(51) Int. Cl.

| | |
|---|---|
| ***C11D 3/50*** | (2006.01) |
| ***C11D 1/22*** | (2006.01) |
| ***C11D 3/20*** | (2006.01) |
| ***C11D 17/04*** | (2006.01) |
| ***C11D 3/30*** | (2006.01) |

(52) U.S. Cl.

CPC ..... *C11D 3/50* (2013.01); *C11D 1/22* (2013.01); *C11D 3/2003* (2013.01); *C11D 3/2044* (2013.01); *C11D 3/2065* (2013.01); *C11D 3/2068* (2013.01); *C11D 3/30* (2013.01); *C11D 17/043* (2013.01); *C11D 17/045* (2013.01)

(58) Field of Classification Search

CPC ..... C11D 11/0017; C11D 3/50; C11D 1/83; C11D 1/72; C11D 1/66; C11D 3/2065; C11D 3/43; C11D 3/2041; C11D 17/0004; C11D 3/0015; C11D 3/2072

See application file for complete search history.

(56) References Cited

U.S. PATENT DOCUMENTS

| | | | | |
|---|---|---|---|---|
| 4,929,380 | A | 5/1990 | Schulz et al. | |
| 5,108,643 | A * | 4/1992 | Loth | C11D 17/0021 510/101 |
| 5,340,390 | A | 8/1994 | Magauran et al. | |
| 5,531,918 | A | 7/1996 | Outtrup et al. | |
| 5,693,520 | A | 12/1997 | Branner et al. | |
| 5,763,385 | A | 6/1998 | Bott et al. | |
| 5,856,164 | A | 1/1999 | Outtrup et al. | |
| 5,858,757 | A | 1/1999 | Von Der Osten et al. | |
| 5,989,169 | A | 11/1999 | Svendsen et al. | |
| 6,093,562 | A | 7/2000 | Bisgard-Frantzen et al. | |
| 6,124,127 | A | 9/2000 | Andersen et al. | |
| 6,136,769 | A | 10/2000 | Asano et al. | |
| 6,159,925 | A | 12/2000 | Blandiaux | |
| 6,242,406 | B1 | 6/2001 | Katsuda et al. | |
| 6,281,187 | B1 | 8/2001 | Smerznak | |
| 6,297,037 | B1 | 10/2001 | Barnett et al. | |
| 6,297,038 | B1 | 10/2001 | Bisgård-Frantzen et al. | |
| 6,300,116 | B1 | 10/2001 | von der Osten et al. | |
| 6,403,331 | B1 | 6/2002 | Henkel Konnarditgesellshaft auf Aktien | |
| 6,429,000 | B1 | 8/2002 | Andersen et al. | |
| 6,576,602 | B1 | 6/2003 | Smerznak | |
| 6,673,589 | B2 | 1/2004 | Borchert et al. | |
| 6,740,630 | B2 | 5/2004 | Aouad et al. | |
| 6,903,064 | B1 | 6/2005 | Kasturi et al. | |
| 7,109,016 | B2 | 9/2006 | Outtrup et al. | |
| 7,169,741 | B2 | 1/2007 | Barry et al. | |
| 7,169,745 | B2 | 1/2007 | Kasturi et al. | |
| 7,183,093 | B2 | 2/2007 | Kauppinen et al. | |
| 7,262,042 | B2 | 8/2007 | Henkel Konnarditgesellshaft auf Aktien | |
| 7,288,401 | B2 | 10/2007 | Hansen et al. | |
| 7,611,882 | B2 | 11/2009 | Bjornvad et al. | |
| 7,723,282 | B2 | 7/2010 | Fleckenstein et al. | |
| 8,535,927 | B1 | 9/2013 | Jones et al. | |
| 8,546,121 | B2 | 10/2013 | Aehle et al. | |
| 8,852,912 | B2 | 10/2014 | Estell et al. | |
| 8,883,970 | B2 | 11/2014 | Andersen et al. | |
| 9,005,950 | B2 | 4/2015 | Glad et al. | |
| 9,150,821 | B2 | 10/2015 | Meier et al. | |

(Continued)

FOREIGN PATENT DOCUMENTS

| | | |
|---|---|---|
| EP | 1 059 351 A1 | 12/2000 |
| EP | 1072673 A2 | 1/2001 |

(Continued)

OTHER PUBLICATIONS

U.S. Appl. No. 15/170,964, filed Jun. 2, 2016, Philip Frank Souter.
U.S. Appl. No. 15/170,966, filed Jun. 2, 2016, Alan Thomas Brooker.
U.S. Appl. No. 15/170,971, filed Jun. 2, 2016, Nigel Patrick Somerville-Roberts.
U.S. Appl. No. 15/170,972, filed Jun. 2, 2016, Alan Thomas Brooker.
U.S. Appl. No. 15/170,973, filed Jun. 2, 2016, Nigel Patrick Somerville-Roberts.
U.S. Appl. No. 15/170,977, filed Jun. 2, 2016, Philip Frank Souter.
U.S. Appl. No. 15/170,978, filed Jun. 2, 2016, Jeremie Robert Marcel Gummel.

(Continued)

*Primary Examiner* — John R Hardee
(74) *Attorney, Agent, or Firm* — Gregory S. Darley-Emerson

(57) ABSTRACT

A liquid laundry detergent composition including: an aldehyde-containing fragrance material, a ketone-containing fragrance material or a mixture thereof; an alcohol a non-amine neutralised linear alkylbenzene sulphonate; a hydroxyl-containing amine; and water.

16 Claims, No Drawings

(56) References Cited

U.S. PATENT DOCUMENTS

| | | | |
|---|---|---|---|
| 9,334,467 | B2 | 5/2016 | Shaw et al. |
| 9,360,659 | B2 | 6/2016 | Stauffer |
| 2004/0018955 | A1 | 1/2004 | Wevers et al. |
| 2006/0003913 | A1 | 1/2006 | Boutique et al. |
| 2006/0035323 | A2 | 2/2006 | Frantzen et al. |
| 2006/0065053 | A1 | 3/2006 | Goto |
| 2007/0010416 | A1 | 1/2007 | Wu et al. |
| 2007/0161531 | A1 | 7/2007 | Draborg et al. |
| 2008/0167213 | A1 | 7/2008 | Fano et al. |
| 2008/0193999 | A1 | 8/2008 | Andersen et al. |
| 2009/0275078 | A1 | 11/2009 | Andersen et al. |
| 2010/0040884 | A1 | 2/2010 | Smets et al. |
| 2010/0279383 | A1 | 11/2010 | Roggen et al. |
| 2011/0146001 | A1* | 6/2011 | Woo ..... A61L 9/01 8/137 |
| 2011/0212876 | A1 | 9/2011 | Meek et al. |
| 2012/0156733 | A1 | 6/2012 | Cuevas et al. |
| 2012/0172275 | A1 | 7/2012 | Jones et al. |
| 2012/0172280 | A1 | 7/2012 | Knotzel et al. |
| 2013/0011882 | A1 | 1/2013 | Cascao-Pereira et al. |
| 2014/0094397 | A1 | 4/2014 | Guida et al. |
| 2014/0201927 | A1 | 6/2014 | Bianchetti et al. |
| 2014/0185916 | A1 | 7/2014 | Fabre et al. |
| 2014/0338134 | A1 | 11/2014 | Fernandez-Prieto et al. |
| 2015/0152401 | A1 | 6/2015 | Cascao-Pereira et al. |
| 2015/0353873 | A1 | 12/2015 | Meek et al. |
| 2016/0177238 | A1 | 6/2016 | Jackson et al. |

FOREIGN PATENT DOCUMENTS

| | | | |
|---|---|---|---|
| WO | WO 89/06270 | | 7/1989 |
| WO | WO 89/06279 | | 7/1989 |
| WO | WO 94/02597 | | 2/1994 |
| WO | WO 95/10603 | | 4/1995 |
| WO | WO 95/23221 | | 8/1995 |
| WO | WO 95/26392 | | 10/1995 |
| WO | WO 96/10072 | A1 | 4/1996 |
| WO | WO 96/034946 | | 11/1996 |
| WO | WO 97/41204 | A1 | 11/1997 |
| WO | WO 98/00514 | A1 | 1/1998 |
| WO | WO 98/00518 | A1 | 1/1998 |
| WO | WO 98/20115 | | 5/1998 |
| WO | WO 99/00471 | | 1/1999 |
| WO | WO 99/019467 | | 4/1999 |
| WO | WO 99/27084 | | 6/1999 |
| WO | WO 00/60060 | | 10/2000 |
| WO | WO 01/44452 | | 6/2001 |
| WO | WO 01/16285 | | 8/2001 |
| WO | WO 02/006442 | | 1/2002 |
| WO | WO 02/010355 | | 2/2002 |
| WO | WO 2004/041979 | | 5/2004 |
| WO | WO 2009/021867 | | 2/2009 |
| WO | WO 2009/135765 | A1 | 11/2009 |
| WO | WO 2013/160023 | A1 | 10/2013 |

OTHER PUBLICATIONS

EP Search Report for Application No. 15170775.9-1358, dated Dec. 2, 2015, 6 pgs.
EP Search Report for Application No. 15170779.1-1358, dated Dec. 14, 2015, 6 pgs.
EP Search Report for Application No. 15170782.5-1358, dated Dec. 11, 2015, 7 pgs.
EP Search Report for Application No. 16158402.4-1358, dated Aug. 11, 2016, 8 pgs.
EP Search Report for Application No. 15170800.5-1358, dated Dec. 14, 2015, 8 pgs.
EP Search Report for Application No. 15170802.1-1358, dated Dec. 11, 2015, 5 pgs.
EP Search Report for Application No. 15170805.4-1358, dated Dec. 10, 2015, 7 pgs.
EP Search Report for Application No. 15170808.8-1358, dated Dec. 11, 2015, 7 pgs.

* cited by examiner

COMPACTED LIQUID LAUNDRY DETERGENT COMPOSITION

FIELD OF THE INVENTION

The present invention is the field of liquid laundry detergent compositions and their methods of use.

BACKGROUND OF THE INVENTION

There is a move in the industry to using so called compacted liquids which minimise the levels of water used. Such liquid laundry detergent compositions require the presence of anionic surfactant such as linear alkylbenzene sulphonate to provide cleaning benefits to fabrics. In order to form phase stable (i.e. compositions that do not phase split) compacted liquids, hydroxyl-containing amine compounds have been used. However, now there is a desire to minimise the levels of such hydroxyl-containing amine compounds in compacted liquids, as these react with certain perfume materials, especially aldehyde and ketone perfume materials, and result in undesirable discoloration of the compositions.

Formulators desire to use such aldehyde and ketone materials to provide consumer preferred scent experiences from compacted liquid laundry detergent compositions. However, removal of hydroxyl-containing amine compounds causes the compositions to phase split which causes issues in accurate dosing of ingredients into the wash.

Thus there is a need in the art for a compacted liquid that is phase stable and comprises aldehyde-containing fragrances, ketone-containing fragrances and mixtures thereof.

It was surprisingly found that the compacted liquids of the present invention were phase stable whilst still allowing the incorporation of aldehyde-containing fragrances, ketone-containing fragrances and mixtures thereof with minimal decolouration of the composition.

SUMMARY OF THE INVENTION

The present disclosure relates to a liquid laundry detergent composition comprising;

- From 0.001% to 5% by weight of the composition of an aldehyde-containing fragrance material, a ketone-containing fragrance material or a mixture thereof;
- From 5% to 40% by weight of the composition of an alcohol having a molecular weight of between 20 and 400 and an eRH of between 50% and 80% at 20° C. as measured via the alcohol eRH test described herein;
- From 10% to 30% by weight of the composition of a non-amine neutralised linear alkylbenzene sulphonate;
- Less than 5% by weight of the composition of a hydroxyl-containing amine;
- From 0.5% to 15% by weight of the composition of water.

The present disclosure relates to a liquid laundry detergent composition comprising;

- From 0.001% to 2% by weight of the composition of an aldehyde fragrance material, a ketone fragrance material or a mixture thereof;
- From 5% to 40% by weight of the composition of an alcohol selected from the group comprising ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal dipropylene glycol, polypropylene glycol, dipropylene glycol n-butyl ether, and mixtures thereof, preferably the solvent is selected from the group comprising 1,2 propanediol, dipropylene glycol, polypropylene glycol, 2,3-butane diol, dipropylene glycol n-butyl ether and mixtures thereof;
- From 10% to 30% by weight of the composition of a non-amine neutralised linear alkylbenzene sulphonate;
- Less than 5% by weight of the composition of a hydroxyl-containing amine;
- From 0.5% to 15% by weight of the composition of water.

DETAILED DESCRIPTION OF THE INVENTION

The liquid laundry detergent composition of the present invention overall is liquid in nature. That is to say, even though it comprises a solid dispersed within a liquid phase, the composition has the nature of a liquid rather than a solid or granular composition. In relation to the laundry detergent composition of the present invention, the term 'liquid' encompasses forms such as dispersions, gels, pastes and the like. The liquid composition may also include gases in suitably subdivided form. However, the liquid composition excludes forms which are non-liquid overall, such as tablets or granules.

The term 'liquid laundry detergent composition' refers to any laundry detergent composition comprising a liquid capable of wetting and treating fabric e.g., cleaning clothing in a domestic washing machine.

The liquid composition may be formulated into a unit dose article. The unit dose article of the present invention comprises a water-soluble film which fully encloses the liquid composition in at least one compartment. Suitable unit dose articles are described in more detail below.

The liquid laundry detergent composition can be used as a fully formulated consumer product, or may be added to one or more further ingredient to form a fully formulated consumer product. The liquid laundry detergent composition may be a 'pre-treat' composition which is added to a fabric, preferably a fabric stain, ahead of the fabric being added to a wash liquor.

The composition of the present invention comprises from 0.001% to 5% by weight of the composition of an aldehyde-containing fragrance material, a ketone-containing fragrance material or a mixture thereof. Suitable aldehyde-containing fragrance materials and ketone-containing fragrance materials are described in more detail below.

The liquid laundry detergent composition comprises from 10% to 30% by weight of the composition of linear alkylbenzene sulphonate.

Preferably, the liquid laundry detergent composition comprises less than 10% by weight, or even less than 5% by weight, or even less than 2% by weight of the liquid laundry detergent composition of an amine-neutralised anionic surfactant, wherein the anionic surfactant is preferably selected from the group comprising linear alkylbenzene sulphonate, alkyl sulphate and mixtures thereof.

The liquid laundry detergent composition comprises between 0.5% and 20% by weight of the composition of water and may have an equilibrium relative humidity of less than 65% at 20° C.

The composition comprises less than 5% by weight of the composition of a hydroxyl-containing amine compound. Suitable amines are described in more detail below.

The liquid laundry detergent composition may comprise a structurant. Suitable structurants are described in more detail below.

The liquid laundry detergent composition of the present invention may comprise adjunct ingredients.

Preferably, the liquid laundry detergent composition has a viscosity of between 300 mPa·s and 700 mPa·s, more preferably between 350 mPa·s and 600 mPa·s at a shear rate of 1000 $s^{-1}$. An exemplary method for measuring viscosity is to use a Rheometer DHR1 from TA instruments using a gap of 1000 μm at 20° C. as according to the manufacturer's instructions.

Aldehyde and Ketone

The composition of the present invention comprises from 0.01% to 5%, or even between 0.002% and 4%, or even between 0.005% and 3% or even between 0.1% and 2% by weight of the composition of an aldehyde-containing fragrance material, a ketone-containing fragrance material or a mixture thereof.

Aldehyde-containing materials are organic compounds that are characterised by having a carbonyl group attached to a hydrogen atom.

Ketone-containing materials are organic compounds characterised by having a carbonyl group attached to two carbon atoms.

The aldehydes and ketone containing materials of the present invention also need to be fragrance materials. Fragrance materials are those that have an odour that can be perceived by the majority of humans. Preferably, the aldehyde-containing and ketone-containing fragrance materials have a molecular weight range from 75 to 450, or even from 80 to 400, or even from 85 to 350. Preferably, the aldehyde-containing and ketone-containing fragrance materials have a log P between 0.25 and 7, or even between 0.5 and 6.75 or even between 0.75 and 6.5. Preferably, the aldehyde-containing and ketone-containing fragrance materials have a vapour pressure at 25° C. in mmHg of between $2.5\times10^{-5}$ and $9.5\times10^{1}$. The aldehyde or ketone-containing fragrance material may be selected from the group comprising (2E,6E)-nona-2,6-dienal, 2,6,10-trimethylundec-9-enal; 1-methyl-4-(4-methylpent-3-enyl)cyclohex-3-ene-1-carbaldehyde; (E)-1-(2,6,6-trimethyl-1-cyclohex-2-enyl)but-2-en-1-one; (E)-4-(2,6,6-trimethyl-1-cyclohex-2-enyl)but-3-en-2-one; 2-benzylideneheptanal; (E)-1-(2,6,6-trimethyl-1-cyclohexenyl)but-2-en-1-one; 4-(2,6,6-trimethylcyclohexen-1-yl)but-3-en-2-one; 3-(4-tert-butylphenyl)propanal, (2Z)-2-benzylidenehexanal; 3-(4-methoxyphenyl)-2-methylpropanal; 3,7-dimethylocta-2,6-dienal; 2-(3,7-dimethyloct-6-enoxy) acetaldehyde; 3-(4-propan-2-ylphenyl)propanal; 3-(4-propan-2-ylphenyl)butanal; (E)-1-(2,6,6-trimethyl-1-cyclohexa-1,3-dienyl)but-2-en-1-one; 1-(2,6,6-trimethyl-1-cyclohex-3-enyl)but-2-en-1-one; 4-ethoxy-3-hydroxybenzaldehyde; 5-methylhept-2-en-4-one; 3-(2-ethylphenyl)-2,2-dimethylpropanal; 3-(3-isopropylphenyl) butanal; 1-(5,5-dimethyl-1-cyclohexenyl)pent-4-en-1-one; (E)-3-methyl-4-(2,6,6-trimethyl-1-cyclohex-2-enyl)but-3-en-2-one; 3-(1,3-benzodioxol-5-yl)-2-methylpropanal; 1,3-benzodioxole-5-carbaldehyde; 2-(phenylmethylidene)octanal; (E)-1-(2,4,4-trimethylcyclohex-2-en-1-yl)but-2-en-1-one; 3-(4-methyl-1-cyclohex-3-enyl)butanal; 2,6-dimethylhept-5-enal; 6-methylhept-5-en-2-one; methylphenyl)methylidene]heptanal; 5,5-dimethyl-2,3,4,4a,6,7-hexahydro-1H-naphthalene-2-carbaldehyde; 2-[2-(4-methyl-1-cyclohex-3-enyl)propyl]cyclopentan-1-one; 2,4-dimethylcyclohex-3-ene-1-carbaldehyde; undec-10-enal; 4-hydroxy-3-methoxybenzaldehyde; 4-methoxybenzaldehyde and mixtures thereof.

The aldehyde or ketone-containing fragrance material is preferably selected from the group comprising (E)-1-(2,6,6-trimethyl-1-cyclohex-2-enyl)but-2-en-1-one; (E)-4-(2,6,6-trimethyl-1-cyclohex-2-enyl)but-3-en-2-one; (E)-1-(2,6,6-trimethyl-1-cyclohexenyl)but-2-en-1-one; 4-(2,6,6-trimethylcyclohexen-1-yl)but-3-en-2-one; 3,7-dimethylocta-2,6-dienal; 3-(4-propan-2-ylphenyl)butanal; (E)-1-(2,6,6-trimethyl-1-cyclohexa-1,3-dienyl)but-2-en-1-one; 1-(2,6,6-trimethyl-1-cyclohex-3-enyl)but-2-en-1-one; 4-ethoxy-3-hydroxybenzaldehyde; 3-(2-ethylphenyl)-2,2-dimethylpropanal; 3-(3-isopropylphenyl)butanal; 1-(5,5-dimethyl-1-cyclohexenyl)pent-4-en-1-one; (E)-3-methyl-4-(2,6,6-trimethyl-1-cyclohex-2-enyl)but-3-en-2-one; 1,3-benzodioxole-5-carbaldehyde; 2-(phenylmethylidene) octanal; 2,4-dimethylcyclohex-3-ene-1-carbaldehyde; undec-10-enal; 4-hydroxy-3-methoxybenzaldehyde; 4-methoxybenzaldehyde and mixtures thereof.

Non-Amine Neutralized Linear Alkylbenzene Sulphonate

The liquid laundry detergent composition comprises from 10% to 30% by weight of the composition of a non-amine neutralized linear alkylbenzene sulphonate. Preferably the linear alkylbenzene sulphonate, is lamellar liquid crystal alkylbenzene sulphonate. By 'lamellar liquid crystal' we herein mean the system being in a state where the surfactant molecules are organised in stacks of bilayers of surfactant in the melted state separated by thin layers of solvent. This structure has both liquid properties in term of flowability as well as solid properties in term of being structured. The structure is characterised by its d-spacing, the sum of the bilayer thickness and the solvent layer between sheets. The repetition and periodicity of this structure yields to sharp x-ray diffraction peaks characteristic of crystal phases.

The liquid laundry detergent composition may comprise from 15% to 25% by weight of the laundry detergent composition of linear alkylbenzene sulphonate, preferably lamellar liquid crystal alkylbenzene sulphonate.

The linear alkylbenzene sulphonate may be present in the form of a solid dispersed with the liquid laundry detergent composition. By 'solid' we herein mean particulate, crystal, liquid lamellar crystal and mixtures thereof.

Non-amine neutralized linear alkylbenzene sulphonates are those in which the linear alkylbenzene sulphonic acid is neutralized to the correspond linear alkylbenzene sulphonate salt using a neutralizing material other than an amine. Non-limiting examples of such neutralizing groups include sodium, potassium, magnesium and mixtures thereof. The non-amine neutralized linear alkylbenzene sulphonate may be a sodium linear alkylbenzene sulphonate, a potassium alkylbenzene sulphonate, a magnesium alkylbenzene sulphonate or a mixture thereof.

The non-amine neutralised linear alkylbenzene sulphonate may be a $C_{10}$-$C_{16}$ linear alkylbenzene sulphonate or a $C_{11}$-$C_{14}$ linear alkylbenzene sulphonate or a mixture thereof.

Exemplary linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Alkyl benzene sulfonates are well known in the art. Especially useful are the sodium, potassium and magnesium linear straight chain alkylbenzene sulfonates in which the average number of carbon atoms in the alkyl group is from about 11 to 14.

The liquid laundry detergent composition may comprise an amine-neutralised linear alkylbenzene sulphonate. Preferably, the liquid laundry detergent composition comprises less than 10%, or even less than 5%, or even less than 3% by weight of the liquid laundry detergent composition of an amine-neutralised linear alkylbenzene sulphonate.

The liquid laundry detergent composition may comprise a non-amine neutralized linear alkylbenzene sulphonate and an amine neutralized linear alkylbenzene sulphonate. The liquid laundry detergent composition may comprise between 10% and 30% by weight of the composition of a non-amine neutralized linear alkylbenzene sulphonate, preferably alkaline earth metal non-amine neutralized linear alkylbenzene sulphonate and less than 10%, or even less than 5%, or even less than 3% by weight of the liquid laundry detergent composition of an amine-neutralised linear alkylbenzene sulphonate, preferably monethanolamine linear alkylbenzene sulphonate, triethanolamine linear alkylbenzene sulphonate or a mixture thereof.

Alcohol

The liquid phase comprises between 5% and 40%, or even between 5% and 20% or even between 5% and 15% by weight of the composition of an alcohol, wherein the alcohol has a molecular weight of between 20 and 400 and an equilibrium relative humidity ("eRH") of between 50% and 80%, or even between 52% and 75% at 20° C. as measured via the alcohol eRH test.

The alcohol eRH test comprises the steps of preparing a solution of 80% alcohol in deionised water, followed by adding this to a calibrated Rotronic Hygrolab meter (in a plastic sample liner of 14 mm depth) at room temperature (20° C.+/−1° C.) and allowing this to equilibrate for 25 minutes, and finally measuring the eRH recorded. The volume of sample used was sufficient to fill the plastic sample liner.

By 'alcohol' we herein mean either a single compound or a mixture of compounds that when taken together collectively each have a molecular weight of between 20 and 400 and an overall eRH of the compound or mixture of between 50% and 80% at 20° C. as measured via the eRH test. Without wishing to be bound by theory, an alcohol is any compound comprising at least one OH unit, preferably polyols and diols, more preferably diols. Preferred diols included glycols.

The alcohol may be selected from the group comprising ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal dipropylene glycol, polypropylene glycol, dipropylene glycol n-butyl ether, and mixtures thereof.

The alcohol may be selected from the group comprising ethylene glycol, 1,2 propanediol, 2,3-butane diol, 1,3 butanediol, triethylene glycol, polyethylene glycol, glycerol formal dipropylene glycol, polypropylene glycol, dipropylene glycol n-butyl ether, and mixtures thereof.

More preferably the alcohol is selected from the group comprising 1,2 propanediol, dipropylene glycol, polypropylene glycol, 2,3-butane diol, dipropylene glycol n-butyl ether and mixtures thereof.

The alcohol may be selected from the group comprising 1,2 propanediol, dipropylene glycol, polypropylene glycol, dipropylene glycol n-butyl ether and mixtures thereof.

Amine

The detergent composition comprises less than 5% by weight of the composition of a hydroxyl-containing amine compound, or even from 0.1% to 5%, or even from 0.1% to 4% by weight of the composition of a hydroxyl-containing amine compound. By 'hydroxyl-containing amine compound' we herein mean a compound comprising an alcohol (OH) group and an amine group. The hydroxyl-containing amine compound may be selected from monoethanolamine, triethanolamine, diisopropanolamine, triisopropanolamine, Monoamino hexanol, 2-[(2-methoxyethyl) methylamino]-ethanol, Propanolamine, N-Methylethanolamine, diethanolamine, Monobutanol amine, Isobutanolamine, Monopentanol amine, 1-Amino-3-(2-methoxyethoxy)-2-propanol, 2-Methyl-4-(methylamino)-2-butanol, 6-amino-1-hexanol, Heptaminol, Isoetarine, Norepinephrine, Sphingosine, Phenylpropanolamine and mixtures thereof.

The hydroxyl-containing amine compound may be selected from the group comprising monoethanol amine, triethanolamine and mixtures thereof.

Preferably, the hydroxyl-containing amine compound has a molecular weight of less than 500, or even less than 250.

The detergent composition may comprise other amine containing compounds.

Other Non-Amine Neutralized Anionic Surfactants

The liquid laundry detergent composition may comprise other non-amine neutralized anionic surfactants, preferably non-amine neutralized alkyl sulphate, more preferably non-amine neutralized ethoxylated alkyl sulphate. The non-amine neutralised anionic surfactant may comprise non-amine neutralised alkyl sulphate, non-amine neutralised ethoxylated alkyl sulphate or a mixture thereof. Preferably the non-amine neutralized alkyl sulphate anionic surfactant is lamellar liquid crystal alkyl sulphate anionic surfactant. The non-amine neutralised anionic surfactant may comprises lamellar liquid crystal alkyl sulphate, lamellar liquid crystal ethoxylated alkyl sulphate or a mixture thereof.

The liquid laundry detergent composition may comprise from 10% to 30% or even from 15% to 25% by weight of the laundry detergent composition of non-amine neutralised alkyl sulphate anionic surfactant, preferably lamellar liquid crystal non-amine neutralized alkyl sulphate anionic surfactant.

The non-amine neutralized alkyl sulphate anionic surfactant may be present in the form of a solid dispersed within the liquid laundry detergent composition. By 'solid' we herein mean particulate, crystal, lamellar liquid crystal and mixtures thereof.

Non-amine neutralized non-amine neutralized alkyl sulphate anionic surfactant are those in which the surfactant acid is neutralized to the correspond salt using a neutralizing material other than an amine. Non-limiting examples of such neutralizing groups include sodium, potassium, magnesium and mixtures thereof. The non-amine neutralized alkyl sulphate anionic surfactant may be a sodium alkyl sulphate anionic surfactant, a potassium alkyl sulphate anionic surfactant, a magnesium alkyl sulphate anionic surfactant or a mixture thereof.

The alkyl sulphate anionic surfactant may be ethoxylated or non-ethoxylated or a mixture thereof.

The non-amine neutralised alkyl sulphate anionic surfactant may be an ethoxylated non-amine neutralised alkyl sulphate anionic surfactant, preferably with an average degree of ethoxylation from 1 to 5, more preferably from 1 to 3. The ethoxylated non-amine neutralised alkyl sulphate anionic surfactant may have an average degree of ethoxylation of 1 or 3 or a mixture thereof, preferably the ethoxylated non-amine neutralised alkyl sulphate anionic surfactant has an average degree of ethoxylation of 1.

The non-amine neutralised alkyl sulphate anionic surfactant may be a $C_{10-18}$ alkyl sulphate, preferably a $C_{10-18}$ ethoxylated alkyl sulphate, most preferably a $C_{10-18}$ ethoxylated alkyl sulphate having an average degree of ethoxylation of from 1 to 5.

The alkyl sulphate anionic surfactant may be ethoxylated or non-ethoxylated or a mixture thereof. The alkyl sulphate anionic surfactant may be a $C_{10}$-$C_{20}$ primary, branched-chain and random alkyl sulfates (AS), including predominantly $C_{12}$ alkyl sulfates. Alternatively, the alkyl sulphate anionic surfactant may be a $C_{10}$-$C_{18}$ secondary (2,3) alkyl sulfates. Alternatively, the alkyl sulphate anionic surfactant may be a $C_{10}$-$C_{18}$ alkyl ethoxy sulfates ($AE_xS$) wherein x is from 1-30. Alternatively, the alkyl sulphate anionic surfactant may be a mixture of all the above alkyl sulphate anionic surfactants. Non-limiting examples of suitable cations for the alkyl sulphate anionic surfactant include sodium, potassium, ammonium, amine and mixtures thereof.

Non-Ionic Surfactant

The liquid laundry detergent composition may comprise a non-ionic surfactant.

The non-ionic surfactant may be a natural or synthetically derived non-ionic surfactant. Preferably, the non-ionic surfactant comprises a natural or synthetically derived fatty alcohol ethoxylate non-ionic surfactant. Preferred synthetically derived fatty alcohol ethoxylate non-ionic surfactant or those derived from the oxo-synthesis process, or so-called oxo-synethesised non-ionic surfactants. The composition may comprise from 0% to 30% or even from 0.1% to 25% by weight of the composition of fatty alcohol ethoxylate non-ionic surfactant.

The ethoxylated nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

The ethoxylated alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $R(EO)_n$, wherein R represents an alkyl chain between 4 and 30 carbon atoms, (EO) represents one unit of ethylene oxide monomer and n has an average value between 0.5 and 20.

The composition may comprise other non-ionic surfactants, preferably natural or synthetic non-ionic surfactants.

Structurant

The composition of the present invention may comprises less than 2% by weight of the composition of a structurant. If a structurant is present, preferably the composition comprises from 0.05% to 2%, preferably from 0.1% to 1% by weight of a structurant. The structurant may be selected from non-polymeric or polymeric structurants. The structurant may be a non-polymeric structurant, preferably a crystallisable glyceride. The structurant may be a polymeric structurant, preferably a fibre based polymeric structurant, more preferably a cellulose fibre-based structurant. The structurant may be selected from crystallisable glyceride, cellulose-fibre based structurants, $TiO_2$, silica and mixtures thereof.

Suitable structurants are preferably ingredients which impart a sufficient yield stress or low shear viscosity to stabilize the liquid laundry detergent composition independently from, or extrinsic from, any structuring effect of the detersive surfactants of the composition. Preferably, they impart to the laundry detergent composition a high shear viscosity at 20 sec-1 at 21° C. of from 1 to 1500 cps and a viscosity at low shear (0.05 sec-1 at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1-1 to 25-1 in 3 minutes time at 21° C.

The composition may comprise a non-polymeric crystalline, hydroxyl functional structurant. Such non-polymeric crystalline, hydroxyl functional structurants generally comprise a cystallizable glyceride which can be pre-emulsified to aid dispersion into the final liquid laundry detergent composition. A non-limiting example of such a pre-emulsified external structuring system comprises: (a) crystallizable glyceride(s); (b) anionic surfactant; and (c) water and optionally, non-aminofunctional organic solvents. Each of these components is discussed in detail below.

The structurant may be a polymeric crystalline, hydroxy-functional structurant that comprises a crystallizable glyceride, preferably hydrogenated castor oil or "HCO". HCO as used herein most generally can be any hydrogenated castor oil or derivative thereof, provided that it is capable of crystallizing in the non-polymeric crystalline, hydroxy-functional structurant premix. Castor oils may include glycerides, especially triglycerides, comprising $C_{10}$ to $C_{22}$ alkyl or alkenyl moieties which incorporate a hydroxyl group. Hydrogenation of castor oil, to make HCO, converts the double bonds which may be present in the starting oil as ricinoleyl moieties. As such, the ricinoleyl moieties are converted into saturated hydroxyalkyl moieties, e.g., hydroxystearyl. The HCO herein may be selected from: trihydroxystearin; dihydroxystearin; and mixtures thereof. The HCO may be processed in any suitable starting form, including, but not limited to those selected from solid, molten and mixtures thereof. HCO is typically present at a level of from 2% to 10%, from 3% to 8%, or from 4% to 6% by weight in the external structuring system. The corresponding percentage of hydrogenated castor oil delivered into a finished laundry detergent product may be below 1.0%, typically from 0.1% to 0.8%. HCO may be present at a level of between 0.01% and 1%, or even between 0.05% and 0.8% by weight of the laundry detergent composition.

HCO of use in the present invention includes those that are commercially available. Non-limiting examples of commercially available HCO of use in the present invention include: THIXCIN® from Rheox, Inc. Further examples of useful HCO may be found in U.S. Pat. No. 5,340,390.

While the use of hydrogenated castor oil is preferred, any crystallisable glyceride can be used within the scope of the invention. Preferred crystallisable glyceride(s) have a melting point of from 40° C. to 100° C.

The structurant may comprise a fibre-based structurant. The structurant may comprise a microfibrillated cellulose (MFC), which is a material composed of nanosized cellulose fibrils, typically having a high aspect ratio (ratio of length to cross dimension). Typical lateral dimensions are 1 to 100, or 5 to 20 nanometres, and longitudinal dimension is in a wide range from nanometres to several microns. For improved structuring, the microfibrillated cellulose preferably has an average aspect ratio (lid) of from 50 to 200,000, more preferably from 100 to 10,000. Microfibrillated cellulose can be derived from any suitable source, including bacterial cellulose, citrus fibers, and vegetables such as sugar beet, chicory root, potato, carrot, and the like.

The structurant may be selected from the group consisting of titanium dioxide, tin dioxide, any forms of modified $TiO_2$, $TiO_2$ or stannic oxide, bismuth oxychloride or bismuth oxychloride coated $TiO_2$, silica coated $TiO_2$ or metal oxide coated $TiO_2$ and mixtures thereof. Modified $TiO_2$ may comprise carbon modified $TiO_2$, metallic doped $TiO_2$ or mixtures thereof. Metallic doped $TiO_2$ may be selected from platinum doped $TiO_2$, Rhodium doped $TiO_2$.

The structurant may comprise silica. Those skilled in the art will know suitable silica materials to use. The silica may comprise fumed silica.

Water and Equilibrium Relative Humidity ("eRH")

The liquid laundry detergent composition comprises between 0.5% and 15% by weight of the composition of water. The liquid laundry detergent composition may comprise between 0.5% and 12%, or even between 0.5% and 10% by weight of the composition of water.

The liquid laundry detergent composition may have an equilibrium relative humidity of less than 65% at 20° C.

A preferred method for measuring the eRH of the composition is via the composition eRH test. The composition eRH test comprises the steps of adding a sample of the composition to a calibrated Rotronic Hygrolab meter (in a plastic sample liner of 14 mm depth) at room temperature (20° C.+/−1° C.) and allowing this to equilibrate for 25 minutes, and finally measuring the eRH recorded. The volume of sample used was sufficient to fill the plastic sample liner.

Adjunct Ingredient

The liquid laundry detergent composition comprises between 20% and 40% by weight of the composition of an adjunct ingredient. The adjunct ingredient may be selected from the group comprising bleach, bleach catalyst, dye, hueing dye, cleaning polymers including alkoxylated polyamines and polyethyleneimines, soil release polymer, surfactant, solvent, dye transfer inhibitors, chelant, enzyme, perfume, encapsulated perfume, polycarboxylate polymers, cellulosic polymers, and mixtures thereof.

Water-Soluble Pouch

The liquid laundry detergent composition may be present in a water-soluble unit dose article. In such an embodiment, the water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns: 5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing. Preferably, the area of print is achieved via flexographic printing, in which a film is printed, then moulded into the shape of an open compartment.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Method of Making

The liquid laundry detergent composition of the present invention may be made using any suitable manufacturing techniques known in the art. Those skilled in the art would know appropriate methods and equipment to make the composition according to the present invention.

HCO premix may be formed by melting HCO and adding into a small volume of a hot liquid laundry detergent composition wherein the composition does not comprise enzymes or perfume materials. The HCO premix is then added to other ingredients to form the liquid laundry detergent composition.

Method of Use

The composition or unit dose article of the present invention can be added to a wash liquor to which laundry is already present, or to which laundry is added. It may be used in an washing machine operation and added directly to the drum or to the dispenser drawer. The washing machine may be an automatic or semi-automatic washing machine. It may be used in combination with other laundry detergent compositions such as fabric softeners or stain removers. It may be used as pre-treat composition on a stain prior to being added to a wash liquor.

EXAMPLES

The following compositions were prepared wherein composition A is according to the present invention and composition B is a comparative composition representative of current on-market executions.

TABLE 1

| Ingredient | Composition A | Composition B |
|---|---|---|
| Linear $C_9$-$C_{15}$ Alkylbenzene sulfonic acid | | 21.46 |
| Sodium Linear $C_9$-$C_{15}$ Alkylbenzene sulfonate | 22.92 | |
| AE1S (78% active) | 18.09 | |
| 90:10 AE2SC24, AE3SC25 | | 14.59 |
| Guerbet alcohol non-ionic surfactant commercially available from BASF as Lutensol XL100 | 0.50 | 0.91 |
| Brightener 49 | 0.312 | 0.38 |
| $C_{12-14}$ alkyl 9-ethoxylate | | 3.81 |
| CMC | 2.09 | |
| Dipropylene Glycol | 19.68 | 2.81 |
| Silicone suds suppressor | 0.048 | |
| Glycerine | 4.67 | 3.81 |
| 1,2-propanediol | | 9.7 |
| 2-Pyridionol-1-oxide | 0.39 | 2.44 |
| Polyacrylate polymer | 0.955 | |
| Citric acid | | 1.40 |
| Fatty acid | | 5.94 |
| Na2SO4 | 4.06 | |
| NaOH | 0.13 | |
| Ethoxylated polyethyleneimine | 4.64 | 1.6 |
| Perfume* | 2.45 | 2.70 |
| PEG-PVAc polymer | 2.40 | 4.4 |
| Tripropylene glycol | 0.08 | |
| Zeolite A | 0.24 | |
| Enzymes | | 0.11 |

TABLE 1-continued

| Ingredient | Composition A | Composition B |
|---|---|---|
| Structurant | | 0.13 |
| Ethanol | | 0.94 |
| Dyes | | 0.01 |
| Monoethanolamine | | 11.45 |
| Misc | 1.53 | 1.74 |
| Water | 9.31 | 9.67 |

To the above compositions, the following perfumes were added;

Perfume A comprised 12.75% by weight of perfume A of aldehydes and 6.45% by weight of perfume A of ketones.

Perfume B comprised 11.1% by weight of perfume B of aldehydes and 14.5% by weight of perfume B of ketones.

Perfume C comprised 0.6% by weight of perfume C of aldehydes and 1.7% by weight of perfume C of ketones.

The colour stability of the various composition and perfume combinations was tested over time. Colour stability of the liquid laundry detergent compositions were tested by aging the test samples at 50° C. for 2 weeks. The colour of the fresh and aged sample were measured with a ColorQuest XE spectrophotometer by HunterLab and L*, a*- and b*-values were obtained. Spectrophotometric measurement were conducted as fresh and at 2 weeks. Photographs of the samples were taken at the same interval.

The temperature of product to be measured was between 18° C. and 25° C. Samples aged in constant temperature rooms were left to equilibrate over night before measurement. Disposable polystyrene (PS) macro-cuvette with capacity of 2.5-4 ml, external dimensions: 12.5×12.5×45 mm and internal dimensions: 10×10×45 mm with optical path of 10 mm produced by VWR or other supplier with same specifications were used. The cuvette has 2 different sides: either opaque or transparent with an arrow on it. Light needs to pass through the transparent sides so the cuvette must be placed with the arrow in the path of the light beam. The product was filled carefully (to avoid bubbles) into the small cuvette. The sample must cover the measuring port completely for consistent results. The removal of air bubbles in liquids is essential before measuring colors. Centrifugation was used to take out bubbles: Product was centrifuged for 5 minutes at 2500 rpm in Eppendorf 5702, or equivalent equipment. Volume to centrifuge was dependent on tubes under use. A minimum volume of 15 ml is necessary. Maximum fill level must not exceed ¾ of the centrifuge tube. If there is opacifier, silicone and/or perfume microcapsules in the formula, the test needs to be executed in reflectance mode. Preparation, standardization and measurement was executed following the instructions of the equipment.

The transmitted or reflected color of a sample was measured using a ColorQuest XE spectrophotometer manufactured by HunterLab. The instrument uses a white-lined diffuse integrating sphere to project light onto the sample. The sample spectrum is collected by the instrument and the software converts spectral data into values of CIE L*, a*, b* and ΔE*2000, where L* is the lightness, a* is the redness or greenness and b* is the yellowness or blueness of the sample. ΔE*2000 is the color difference from a standard sample or L*, a*, b* color scale which gives tolerances for perceptible or acceptable color differences based on consumer relevant data. The performance of the equipment is checked by regular standardizations of the color meter using calibrated tiles supplied by HunterLab.

Colour stability was measured as fresh and after 2 weeks of aging at 50° C. for compositions A and B with the different perfume compositions. Results after aging were compared to fresh sample colour measurements, and the difference in colour recorded. Results can be seen in Table 2;

TABLE 2

| | Perfume A | | Perfume B | | Perfume C | |
|---|---|---|---|---|---|---|
| | Composition A | Composition B | Composition A | Composition B | Composition A | Composition B |
| Color stability after 2 w 50 C. ΔE2000 | 0.85 | 8.54 | 3.05 | 7.25 | 2.07 | 6.79 |

As can be seen from Table 2, for all perfume compositions tested, Composition A according to the present invention showed lower levels of discolouration versus fresh sample than Composition B with the same perfumes.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition comprising:

from about 0.05% to about 1% by weight of the composition of a fragrance material selected from an aldehyde-containing fragrance material, a ketone-containing fragrance material or a mixture thereof;

from about 5% to about 40% by weight of the composition of an alcohol that is 1,2 propanediol;

from about 15% to about 25% by weight of the composition of a sodium neutralised $C_{11}$-$C_{14}$ linear alkylbenzene sulphonate;

a non-ionic surfactant;

less than about 5% by weight of the composition of a hydroxyl-containing amine;

from about 0.5% to about 15% by weight of the composition of water; and an adjunct ingredient, wherein the adjunct ingredient is selected from the group comprising bleach, bleach catalyst, dye, hueing dye, cleaning polymers, soil release polymer, dye transfer inhibitors, chelant, enzyme, perfume, encapsulated perfume, polycarboxylate polymers, cellulosic polymers, and mixtures thereof.

2. A liquid laundry detergent composition according to claim 1 wherein the fragrance material is selected from the group consisting of: (2E,6E)-nona-2,6-dienal, 2,6,10-trimethylundec-9-enal; 1-methyl-4-(4-methylpent-3-enyl)cyclohex-3-ene-1-carbaldehyde; (E)-1-(2,6,6-trimethyl-1-cyclohex-2-enyl)but-2-en-1-one; (E)-4-(2,6,6-trimethyl-1-cyclohex-2-enyl)but-3-en-2-one; 2-benzylideneheptanal; (E)-1-(2,6,6-trimethyl-1-cyclohexenyl)but-2-en-1-one; 4-(2,6,6-trimethylcyclohexen-1-yl)but-3-en-2-one; 3-(4-tert-butylphenyl)propanal, (2Z)-2-benzylidenehexanal; 3-(4-methoxyphenyl)-2-methyl propan al; 3,7-dimethylocta-2,6-dienal; 2-(3,7-dimethyloct-6-enoxy)acetaldehyde; 3-(4-propan-2-ylphenyl)propanal; 3-(4-propan-2-ylphenyl)butanal; (E)-1-(2,6,6-trimethyl-1-cyclohexa-1,3-dienyl)but-2-en-1-one; 1-(2,6,6-trimethyl-1-cyclohex-3-enyl)but-2-en-1-one; 4-ethoxy-3-hydroxybenzaldehyde; 5-methylhept-2-en-4-one; 3-(2-ethylphenyl)-2,2-dimethylpropanal; 3-(3-isopropylphenyl)butanal; 1-(5,5-dimethyl-1-cyclohexenyl)pent-4-en-1-one; (E)-3-methyl-4-(2,6,6-trimethyl-1-cyclohex-2-enyl)but-3-en-2-one; 3-(1,3-benzodioxol-5-yl)-2-methylpropanal; 1,3-benzodioxole-5-carb aldehyde; 2-(phenylmethylidene)octanal; (E)-1-(2,4,4-trimethylcyclohex-2-en-1-yl)but-2-en-1-one; 3-(4-methyl-1-cyclohex-3-enyl)butanal; 2,6-dimethylhept-5-enal; 6-methylhept-5-en-2-one; methylphenyl)methylidene]heptanal; 5,5-dimethyl-2,3,4,4a,6,7-hexahydro-1H-naphthalene-2-carb aldehyde; 2-[2-(4-methyl-1-cyclohex-3-enyl)propyl]cyclopentan-1-one; 2,4-dimethyl cyclohex-3-ene-1-carbaldehyde; undec-10-enal; 4-hydroxy-3-methoxybenzaldehyde; 4-methoxybenzaldehyde; and mixtures thereof.

3. A liquid laundry detergent composition according to claim 2 wherein the fragrance material is selected from the group consisting of: (E)-1-(2,6,6-trimethyl-1-cyclohex-2-enyl)but-2-en-1-one; (E)-4-(2,6,6-trimethyl-1-cyclohex-2-enyl)but-3-en-2-one; (E)-1-(2,6,6-trimethyl-1-cyclohexenyl)but-2-en-1-one; 4-(2,6,6-trimethylcyclohexen-1-yl)but-3-en-2-one; 3,7-dimethylocta-2,6-dienal; 3-(4-propan-2-ylphenyl)butanal; (E)-1-(2,6,6-trimethyl-1-cyclohexa-1,3-dienyl)but-2-en-1-one; 1-(2,6,6-trimethyl-1-cyclohex-3-enyl)but-2-en-1-one; 4-ethoxy-3-hydroxybenzaldehyde; 3-(2-ethylphenyl)-2,2-dimethylpropanal; 3-(3-isopropylphenyl)butanal; 1-(5,5-dimethyl-1-cyclohexenyl)pent-4-en-1-one; (E)-3-methyl-4-(2,6,6-trimethyl-1-cyclohex-2-enyl)but-3-en-2-one; 1,3-benzodioxole-5-carbaldehyde; 2-(phenylmethylidene)octanal; 2,4-dimethylcyclohex-3-ene-1-carbaldehyde; undec-10-enal; 4-hydroxy-3-methoxybenzaldehyde; 4-methoxybenzaldehyde; and mixtures thereof.

4. A liquid laundry detergent composition according to claim 1 wherein the aldehyde-containing fragrance material, ketone-containing fragrance material, or a mixture thereof have a molecular weight from about 75 to about 450.

5. A liquid laundry detergent composition according to claim 1 wherein the aldehyde-containing fragrance material, ketone-containing fragrance material, or a mixture thereof have a log P between about 0.25 and about 7.

6. A liquid laundry detergent composition according to claim 1 wherein the aldehyde-containing fragrance material, ketone-containing fragrance material or a mixture thereof have a vapour pressure at about 25° C. of between about $2.5\times10^{-5}$ mmHg and about $9.5\times10^{1}$ mmHg.

7. A liquid laundry detergent composition according to claim 1 further comprising potassium linear alkylbenzene sulphonate, magnesium linear alkylbenzene sulphonate sodium alkyl sulphate, potassium alkyl sulphate, magnesium alkyl sulphate, or mixture thereof.

8. A liquid laundry detergent composition according to claim 1 further comprising other non-amine neutralized anionic surfactants.

9. A liquid laundry detergent composition according to claim 1 wherein the composition comprises from about 5% to about 20% by weight of the composition of the alcohol.

10. A liquid laundry detergent composition according to claim 1 comprising from above 0% to about 5%, by weight of the composition of the hydroxyl-containing amine.

11. A liquid laundry detergent composition according to claim 1 wherein the hydroxyl-containing amine is selected from the group comprising monoethanol amine, triethanolamine and mixtures thereof.

12. A liquid laundry detergent composition according to claim 1 comprising from about 0.1% to about 5%, by weight of the composition of the hydroxyl-containing amine, preferably wherein the hydroxyl-containing amine is selected from the group comprising monoethanol amine, triethanolamine, and mixtures thereof.

13. A liquid laundry detergent composition according to claim 1 comprising from above 0% to about 30% by weight of the composition of the non-ionic surfactant.

14. A liquid laundry detergent composition according to claim 1 further comprising a structurant.

15. A water-soluble unit dose article comprising a water-soluble film and a detergent composition according to claim 1.

16. The unit dose article according to claim 15 wherein the liquid laundry detergent composition comprises from about 0% to about 30% by weight of the composition of a non-ionic surfactant, wherein the unit dose article comprises at least two compartments.

* * * * *